United States Patent [19]

Kniep

[11] 4,126,999

[45] Nov. 28, 1978

[54] DEVICE FOR VIBRATING THE SOIL

[76] Inventor: Joris Kniep, No. 14, Moerdijksestraat, Oudenbosch, Netherlands

[21] Appl. No.: 808,444

[22] Filed: Jun. 21, 1977

[30] Foreign Application Priority Data

Jun. 30, 1976 [NL] Netherlands ..... 7607220

[51] Int. Cl.[2] ..... E01C 19/30; E02D 3/06

[52] U.S. Cl. ..... 405/258; 166/175; 175/19; 404/133; 405/303

[58] Field of Search ..... 61/36 R, 63; 175/19, 175/55, 56; 404/133; 166/175

[56] References Cited

U.S. PATENT DOCUMENTS

| | | | |
|---|---|---|---|
| 3,712,067 | 1/1973 | Van Weele | 61/36 R |
| 3,865,501 | 2/1975 | Kniep | 175/56 |

*Primary Examiner*—Jacob Shapiro

*Attorney, Agent, or Firm*—Lewis H. Eslinger

[57] ABSTRACT

The ground vibrator comprises a rod to be inserted into the ground and having at its end axial resonance plates, which are brought into vibration by means of a vibration source arranged at the top end of the rod.

The vibration effect of the resonance plates is improved, when the direction of vibration of the vibration source exhibits a departure from the longitudinal axis of the rod.

21 Claims, 13 Drawing Figures

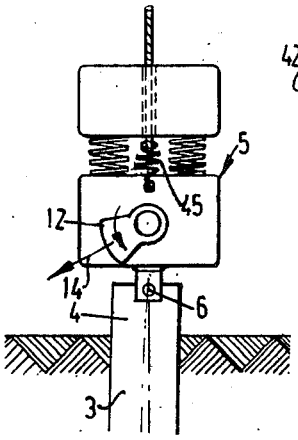
FIG.7
FIG.9
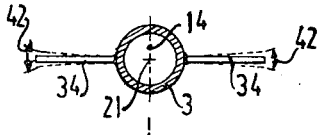
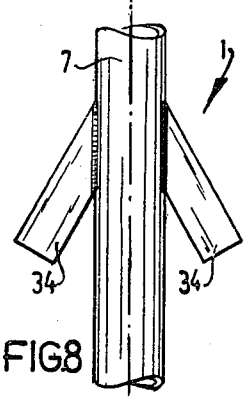
FIG8
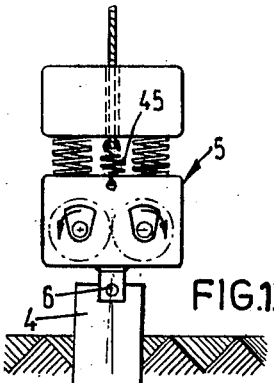
FIG.12
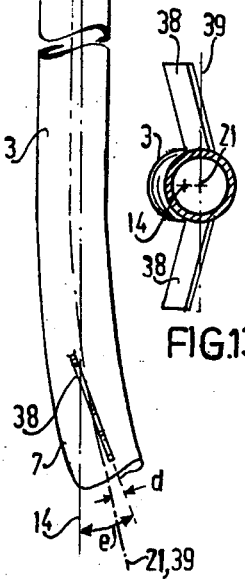
FIG.13
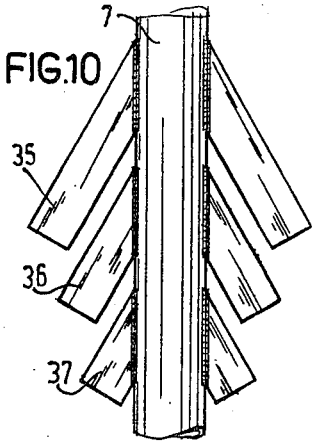
FIG.10
FIG.11
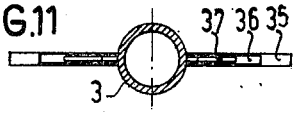

DEVICE FOR VIBRATING THE SOIL

The invention relates to a device for causing the soil to vibrate comprising at least one rod to be inserted into the ground, a source of vibrations arranged at the top end of the rod and resonance means arranged at the lower end of the rod.

Such a device is known and is employed for densifying soil, for forming cavities in the ground to be filled out with sand or cement and/or for loosening objects clamped in the ground, such as piles. The effect of the device is higher according as the resonance means irradiate more resonance energy. In the device of the kind set forth known from Dutch Patent Specification No. 140,310 the vibration direction of the source extends in the direction of length of the rod. Therefore the energy of the vibration source is converted only for a small part into resonance energy of the resonance means.

The invention has for its object to improve the irradiation of resonance energy.

For this purpose the direction of vibration of the vibration source exhibits, in operation, a defined departure from the longitudinal axis of the rod. As a result the lateral path of vibration of the lower end of the rod is enlarged so that the resonance means are more effectively excited, as a result of which a materially larger part of the vibration energy is converted into resonance energy of the resonance means, which means thus have a great effect on the soil. These resonance means, particularly in the form of resonance plates, effectively engage the soil and also cause the ambient soil to vibrate. The frequency of the vibration source is preferably chosen or adjusted so that the resonance means or at least part thereof will vibrate with their natural frequency. The deviation of the direction of vibration from the direction of length of the rod may be obtained in many ways, which will become evident from the following, non-limiting summary:

The rod may be curved or be bent during operation, it may have a varied profile or it may be helical.

The direction of vibration may be outside the centre line of the rod or it may be at a fixed or adjustable angle to the centre line.

Since the effect of the device is stronger according as the resonance means and/or the ground are excited with a frequency approaching more closely their natural frequency, the source of vibrations preferably has a variable frequency, and the device is characterized by a control-member for controlling the frequency of the vibration source in dependence upon a measured resonance frequency of the ground and/or the resonance means are formed by different resonance elements having different natural frequencies.

The aforesaid and further features of the invention will be described more fully hereinafter with reference to a drawing.

In the drawing there show schematically

Figures 1, 2, 3, 4, 5, 6:
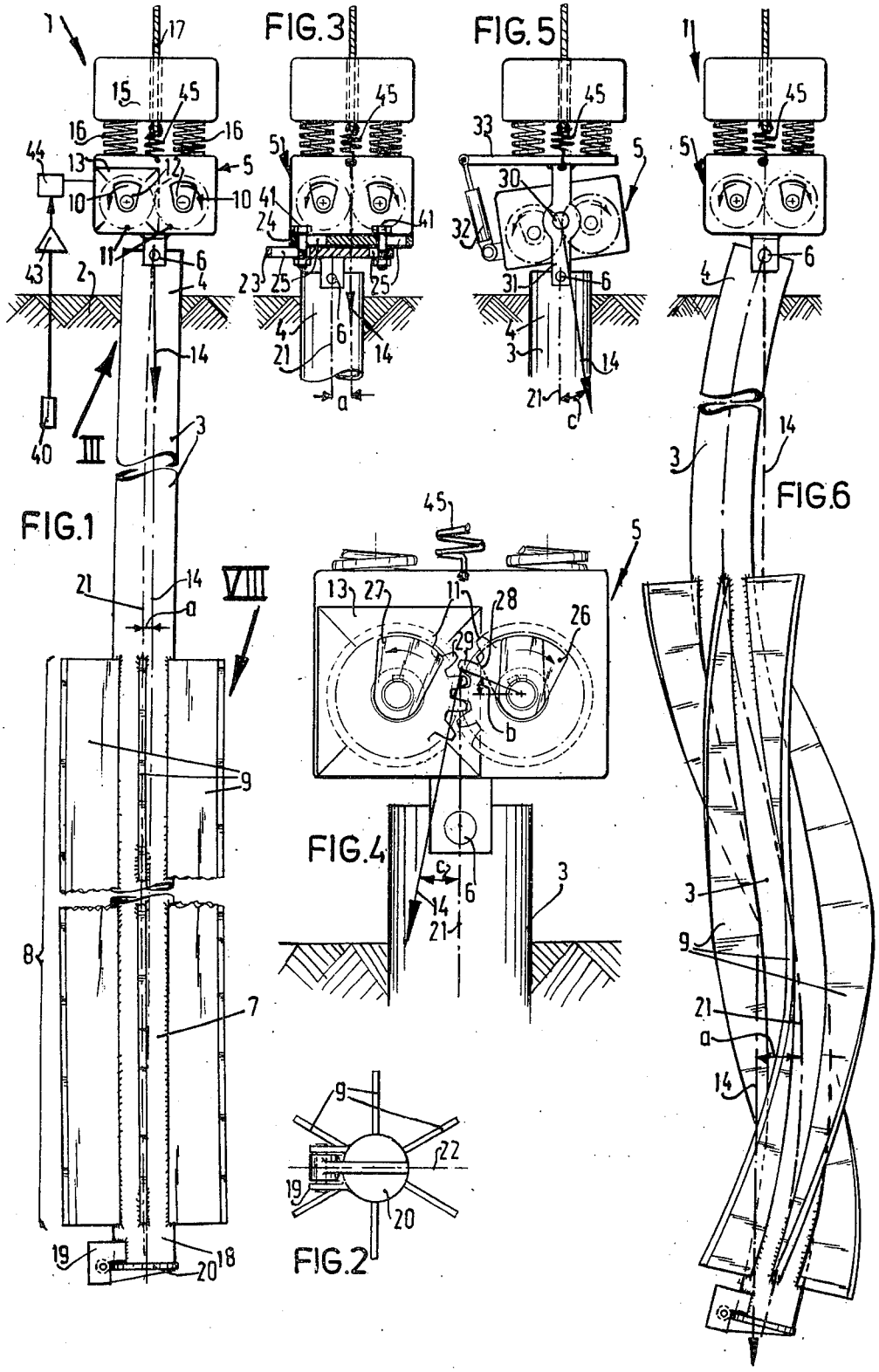
FIG. 1 is a side elevation of a device embodying the invention.
FIG. 2 is a bottom view of the device shown in FIG. 1.

FIGS. 3,4,5 and 7 each a variant of detail III in FIG. 1,

FIG. 6 a perspective view of a further device embodying the invention,

FIGS. 8 and 10 each a side elevation of further variants of detail VIII in FIG. 1, FIGS. 9 and 11 a bottom view of the detail of FIG. 8 and FIG. 10 respectively, FIG. 12 a side elevation of a further embodiment of the invention, FIG. 13 a bottom view of the device of FIG. 12.

The device 1 shown in FIG. 1 for causing the ground 2 to vibrate comprises a hollow rod 3 to be inserted into the ground 2, a vibration source 5 arranged at the top end 4 of the rod 3 by means of a coupling member 6 and resonance means 8 arranged at the lower end 7 of the rod 3 formed by resonance elements each having the form of a resonance plate 9.

The vibration source 5 comprises two mutually coupled imbalance means 12 adapted to rotate in opposite senses in the directions of the arrows 10 and being driven via pinions 11 by an electric motor 13 and giving off in the direction 14 a vibratory force changing its sense in each vibration cycle. On the vibration source 5 is disposed a ballast 15 with the interposition of springs 16. The ballast 15 has a bore so that a cable 17 can be fastened via a tensile spring 45 to the vibration source 5. To the lower end 18 of the rod 3 is welded a housing 19, on which a flap 20 is journalled. This flap 20 completely closes the open end 18 of the hollow rod 3 in the position shown. This structure corresponds to Dutch patent application no. 69.17528. When the rod 3 is pressed into the ground 2, the flap 20 automatically closes, but when the rod 3 inserted into the ground 2 is drawn up, the flap 20 opens and the injection of foreign material into the space beneath the flap 20 can start. When the rod 3, after the injection, is again pressed downwards, the flap 20 closes and the foreign material beneath the flap 20 is moved radially outwards under the action of the vibration into the surrounding ground 2. The vibration source 5 should be capable of exerting an alternating force in the direction of length of the rod 3 with a frequency of, for example, 8 to 50 Hz.

Radially projecting resonance plates 9 are welded or otherwise secured to the rod 3 so as to extend in the direction of length of the rod 3. In the embodiment shown in FIGS. 1 and 2 six plates 9 of rectangular shape are regularly distributed along the circumference of the rod 3. The shape, the dimensions, the thickness of material, the kind of material and the effective surfaces of the resonance plates 9 are preferably chosen as a function of the frequency available from the vibration source 5 so that by the resonance of the plates 9 much energy is transferred to the ground 2 surrounding the plates 9.

According to the invention the direction of vibration 14 of the source 5 exhibits a defined deviation from the longitudinal axis 21 of the rod 3. This deviation is indicated in FIG. 1 by the distance *a* due to the curved shape of the rod 3, which imparts an alternating moment to the rod 3 as a result of which a strong vibration is imparted with certainty to the resonance plates 9 being at right angles to the plane 22 of the curvature. If this occurs with a frequency corresponding with the natural frequency of these resonance plates 9, much vibratory energy can be transferred to the ambient ground 2.

In the variant shown in FIG. 3 the coupling means 6 is fastened through a mounting plate 23 to flanges 24 of the vibration source 5. Fastening bolts 41 extend through elongated holes 25 in the mounting plate 23 and the flanges 24. In this way the direction of vibration 14 of the vibration source 5 can be adjusted at a variable distance *a* from the longitudinal axis 21 of the rod 3.

In the variant shown in FIG. 4 an imbalance means 26 is off-set over an angular distance *b* with respect to the mirror image 28 indicated by broken lines of the imbalance means 27, which can be achieved in a simple manner by shifting the engagement between the pinions 11 by one or more teeth 29. This results in that the direction of vibration 14 is now at an angle *c* to the longitudinal axis 21 of the rod 3 so that again a vibration moment is introduced into the rod 3, which causes the lower end 7 to vibrate additionally in the plane of said moment (the plane of the drawing). Thus the resonance plates 9 being at right angles to said plane are thus additionally activated.

In the variant shown in FIG. 5 the adjustment of the angle *c* between the direction of vibration 14 and the longitudinal axis 21 of the rod 3 can be carried out during operation, since the vibration source 5 is adjustable about a pivotal shaft 30 with respect to a bracket 31, which connects the coupling means 6 with a supporting plate 33 by means of a hydraulic cylinder 32, arranged between the supporting plate and the vibration source 5.

In the variant of FIG. 6 a distance *a* is created between the direction of vibration 14 and the longitudinal axis 21 of the rod 3 by constructing the rod 3 in a slightly helical fashion so that the vibratory moment subjects the rod 3 by a varying load to a torsional effect, as a result of which all radial resonance plates 9 are excited in an efficacious manner. FIG. 6 shows the helical shape on an exaggerated scale.

In the variant of FIG. 7 the direction of vibration 14 constantly changes, since the vibration source 5 comprises only one rotatable imbalance means 12. This simple vibration source 5 has a great effect because it subjects the top end 4 and hence also the lower end 7 of the rod 3 to a strong transverse vibration which vigorously excites the resonance plates 9.

Instead of using six resonance plates 9 as shown in FIG. 2, it is preferred to use two resonance plates 34 in the device 1 shown in FIGS. 8 and 9. The resonance plates 34 have a great length, since they extend downwards in an inclined position, although they do not extend far in a radial direction by way of comparison, so that they do not encounter much resistance when inserted into the ground. The two resonance plates 34 extend radially and at right angles to the plane going through the direction of vibration 14 and the longitudinal axis 21 in order for the resonance plates 34 to be additionally excited to vibrate in the direction of the arrows 42.

The variant shown in FIGS. 10 and 11 comprises in overlying position three different resonance plates 35,36 and 37 having respectively decreasing thickness and different shapes so that the natural frequencies of the resonance plates 35, 36 and 37 are different. Therefore, in the varying mode of excitation and under the varying operational conditions there is likely to be each time at least one set of resonance plates which vibrates strongly.

In the variant illustrated in FIGS. 12 and 13 resonance plates 38, which at the same time constitute guide plates, are fastened to the rod 3 at a small angle *d* of, for example, 10° to the vertical central, longitudinal plane 39 so that in operation the rod 3 is slightly curved and the resonance plates 38 are definitely excited owing to the resultant angular deviation *e* between the direction of vibration 14 and the longitudinal axis 21 despite the fact that the rod 3 is straight in the starting position.

In order to subject the ambient ground 2 to the strongest possible resonance the vibration source 5 is preferably driven by means of an electric motor having a variable speed so that the frequency *w* of the vibration source 5 can be adjusted to that frequency which most closely approaches the natural frequency of the ground 2.

Preferably, as is illustrated in FIG. 1, the vibration frequency of the ground 2 is recorded by a vibration frequency pick-up 40, which is disposed at a distance from the rod 3 in the ground 2. The vibration frequency pick-up 40 is connected through an amplifier 43 to a control-member 44 which controls the speed of the motor 13 and hence the vibration frequency of the vibration source 5 so that the ground 2 will vibrate at its natural frequency. As the case may be, the vibration source 5 may be temporarily driven with a frequency exceeding the calculated, admissible frequency of the vibration source 5 at a given imbalance, although in an operation of long duration for densifying ground the vibratory force F radiated by the vibration source 5 is kept equal to the maximum force $F_{max}$ for which the vibration source 5 has been constructed. Therefore, in accordance with the formula: $F_{max} = r.m \times w^2$ in the event of an increase in imbalance (rm) the square of the frequency *w* is varied inversely proportionally in order to keep the vibratory force $F_{max}$ constantly at the same maximum value.

What I claim is:

1. A ground vibrator comprising: at least one elongated rod adapted to be inserted into the ground, said rod having upper and lower ends; a vibration source operatively engaged with the upper end of the rod for vibrating the rod; at least one reasonance element secured to the lower end of the rod and at least one of said rod and vibration source including means for establishing the direction of vibrations from the vibration source such that the direction of said vibrations exhibits a defined departure from the longitudinal axis of the rod.

2. A device as claimed in claim 1, wherein the direction of vibration of the vibration source lies outside the centre line of the rod.

3. A device as claimed in claim 1 wherein said means for establishing the direction of said vibration comprises a curved shape in said rod.

4. A device as claimed in claim 3 wherein the rod has a helical shape.

5. A device as claimed in claim 1 wherein the direction of vibration of the vibration source is at an angle to the center line of the rod.

6. A device as claimed in claim 1 wherein said establishing means includes means for adjusting said departure.

7. A device as claimed in claim 1 wherein said establishing means includes means for adjusting the direction of vibration with respect to the centre line of the rod.

8. A device as claimed in claim 1, wherein the vibration source has a variable frequency.

9. A device as claimed in claim 8, including means for controlling the frequency of the vibration source in dependence upon the measured reasonance frequency of the ground.

10. A device as claimed in claim 8 wherein the frequency and the imbalance of the vibration source are inversely variable so that the increase in imbalance (rm) is inversely proportional to the square of the increase in frequency (w).

11. A device as claimed in claim 8 characterized in that the vibration source can be temporarily driven with a frequency exceeding the calculated, admissible frequency at a given imbalance.

12. A device as claimed in claim 1 wherein said means for establishing the direction of vibration comprises means for rotating the direction of the vibrations during each vibration cycle.

13. A device as claimed in claim 1 wherein said at least one resonance element comprises a plurality of different resonance elements having different natural frequencies.

14. A device as claimed in claim 1 wherein said at least one resonance element comprises at least one resonance plate positioned in a plane substantially extending in the axial direction of the rod.

15. A device as claimed in claim 1 wherein said at least one resonance element comprises a plurality of standing resonance plates extending in different radial directions.

16. A device as claimed in claim 15 characterized in that the resonance plates have different natural frequencies.

17. A device as claimed in claim 16, characterized in that the thicknesses of the resonance plates are different.

18. A device as claimed in claim 16 characterized in that the lengths of the resonance plates are different.

19. A device as claimed in claim 16, characterized in that at least one resonance plate extends downwardly away from its fastening area on the rod.

20. A device as claimed in claim 1 wherein said rod is normally straight and said means for establishing the direction of vibration comprises guide plates secured to said lower end of the rod at an angle to the direction of length of the rod, which plates bend the rod in the ground out of its straight position to establish the direction of said vibrations at a defined departure from the longitudinal axis of the rod.

21. A device as claimed in claim 9 wherein the frequency and the imbalance of the vibration source are inversely variable so that the increase in the imbalance is inversely proportional to the square of the increase in frequency.

* * * * *